US007984887B1

(12) United States Patent
Visser

(10) Patent No.: US 7,984,887 B1
(45) Date of Patent: Jul. 26, 2011

(54) DEVICE AND METHOD FOR SECURING A LADDER

(76) Inventor: Sean M. Visser, Pioneer, CA (US)

( * ) Notice: Subject to any disclaimer, the term of this patent is extended or adjusted under 35 U.S.C. 154(b) by 816 days.

(21) Appl. No.: 11/903,843

(22) Filed: Sep. 25, 2007

(51) Int. Cl.
*E06C 7/00* (2006.01)

(52) U.S. Cl. ..... 248/210; 248/220.21; 182/129

(58) Field of Classification Search ..... 248/210, 248/220.21, 220.22, 500, 505; 182/127, 182/129; 224/310, 315, 319
See application file for complete search history.

(56) References Cited

U.S. PATENT DOCUMENTS

| | | | | | |
|---|---|---|---|---|---|
| 1,376,924 | A * | 5/1921 | Dixson | ..... | 182/119 |
| 3,139,154 | A * | 6/1964 | Ewald | ..... | 182/106 |
| 3,568,801 | A * | 3/1971 | Werner | ..... | 182/214 |
| 4,031,981 | A * | 6/1977 | Spencer | ..... | 182/153 |
| 4,036,463 | A * | 7/1977 | Hopkins et al. | ..... | 248/210 |
| 4,279,327 | A * | 7/1981 | Warren | ..... | 182/206 |
| D272,857 | S | 2/1984 | Leach | | |
| 5,154,258 | A | 10/1992 | Krukow | | |
| 5,584,357 | A * | 12/1996 | Gugel et al. | ..... | 182/129 |
| 5,918,488 | A | 7/1999 | Deeter | | |
| 5,996,736 | A | 12/1999 | Stankiewicz | | |
| 6,290,113 | B1 | 9/2001 | Plyler | | |
| 6,443,260 | B1 * | 9/2002 | Katz et al. | ..... | 182/129 |
| 6,688,428 | B2 | 2/2004 | Carroll, Jr. | | |
| 6,837,338 | B2 * | 1/2005 | Grover | ..... | 182/107 |
| 6,942,063 | B1 * | 9/2005 | Huett, Jr. | ..... | 182/129 |
| 2007/0039780 | A1 * | 2/2007 | Vergote | ..... | 182/129 |

* cited by examiner

*Primary Examiner* — Terrell McKinnon
*Assistant Examiner* — Steven M Marsh
(74) *Attorney, Agent, or Firm* — T.L. Garrett, PLC; Tanya L. Garrett

(57) ABSTRACT

A ladder locking device having a harness and a lock shuttle for retaining a ladder on a rack or other storage device. The harness having a pair of parallel spaced apart arms and an intermediary arm integrally formed with the spaced apart arms. The lock shuttle having a pair of harness holes adapted to receive the pair of spaced apart arms of the harness and a pair of thumb release assemblies adapted to retain the harness in the lock shuttle and to release the harness from the lock shuttle. The intermediary arm and the lock shuttle each have a flexible pad. The pad of the lock shuttle is retained in a pad holder and there is an adjustment knob in mechanical communication with the pad holder that moves the pad holder from an expanded position to a retracted position to securely retain a ladder on a storage device.

15 Claims, 7 Drawing Sheets

DEVICE AND METHOD FOR SECURING A LADDER

FIELD OF THE INVENTION

The present invention generally relates to a device and a method for securely holding a ladder or other object in position for transporting, storage, or safekeeping.

BACKGROUND

Ladders are frequently transported on vehicles such as vans, panel trucks, and pickup trucks. There are many different types of vehicular racks utilized for this purpose. However, once the ladder is positioned on the rack, the ladder is often free to move about thereby producing objectionable noises, causing abrasive wear on the ladder and the rack, and being readily susceptible to theft. In more extreme cases, the ladder may even become detached from the rack, and fall to the ground such as during travel over rough roads. Even though there is a wide range of racks that are utilized for carrying ladders and/or other items, it would be highly desirable to provide a ladder locking mechanism that would operate with virtually any already existing vehicular rack system and thereby inexpensively help eliminate objectionable noises, abrasive wear on the ladder and the rack, susceptibility to theft, and falling from the rack.

Ladders are commonly used in various construction projects, and therefore must be transported to and from the work site. Many trucks and other vehicles used to transport equipment have racks on which a ladder may be placed. However, these racks do not include means for securing the ladder. Thus, ladders are frequently just tied to the vehicle, and may become loose during transport and fall into the road, where they may be lost, damaged or even cause accidents. Furthermore, while the vehicle is unattended, a thief can untie and remove the ladder. Alternatively, ladders are commonly stored in sheds and garages. There exist racks for storing ladders, however these racks do not provide a means for securing a ladder from theft. It would be advantages to have a bracket that can lock a ladder onto a stationary rack to prevent the ladder from being stolen.

The use of devices and methods relating to ladder locking devices are disclosed in U.S. Pat. Nos. Des. 272,867 issued in the name Leach; 5,154,258 issued in the name Krukow; 5,918,488 issued in the name Deeter, 5,996,736 issued in the name Stankiewicz; 6,290,113 issued in the name Plyler; and 6,688,428 issued in the name Carroll, Jr.

While existing devices suit their intended purpose, the need remains for a device and method that is able to provide an inexpensive means for locking ladders to racks of many different types which may be utilized to provide safer and more reliable storage of ladders and transportation of ladders on vehicles with already existing vehicular racks as well as newly designed racks.

SUMMARY

An improved attachment bracket for holding a ladder on a vehicle, and preventing its unauthorized removal is provided. The attachment bracket is a ladder locking device for holding a ladder on a rack or other storage device having a harness and a lock shuttle. The lock shuttle slides over the harness and is fixedly positioned with respect to the harness using a plurality of thumb releases to hold the lock shuttle in a desired position on the harness. The bracket is easy to use and simple and rugged enough to function in the often harsh dirty environment of a construction site.

BRIEF DESCRIPTION OF THE DRAWINGS

These and other objects, features and advantages of the present invention will become apparent from the following detailed description and the appended drawings in which.

DETAILED DESCRIPTION OF THE INVENTION

An improved attachment bracket for holding a ladder on a vehicle, and preventing its unauthorized removal, would be highly advantageous. The bracket should be easy to use and simple and rugged enough to function in the often dirty environment of a construction site.

The present area of technology is directed to a ladder locking device that may removably secure a ladder to a rack on a vehicle or to a stationary structure. The locking device operates by sliding over a ladder and a ladder rack holding the ladder and securely holding the ladder in place on the rack. The locking device may be further secured with one or a plurality of padlocks that install on the locking device to further secure the ladder and prevent the ladder from being stolen. The locking device replaces bungee cords, straps, ropes and other materials and methods used to securely hold a ladder on a ladder rack. The locking device may securely hold a plurality of ladders on a ladder rack.

The locking device includes a lock shuttle and a harness. The lock shuttle slides over the harness and clicks into place using a plurality of thumb locks to hold the lock shuttle in position. The lock shuttle has a lock knob that tightens the locking device onto the ladder and the rack when the lock knob is twisted into position. The locking device is released from the ladder and the rack by untwisting the lock knob, releasing the thumb locks, and sliding the lock shuttle off of the harness. The lock shuttle and harness are made of substantially rigid materials that exist or may come into existence such as steel, kevlar, or other rigid material that can securely retain a ladder on a ladder rack or other storage device.

Figure 1:
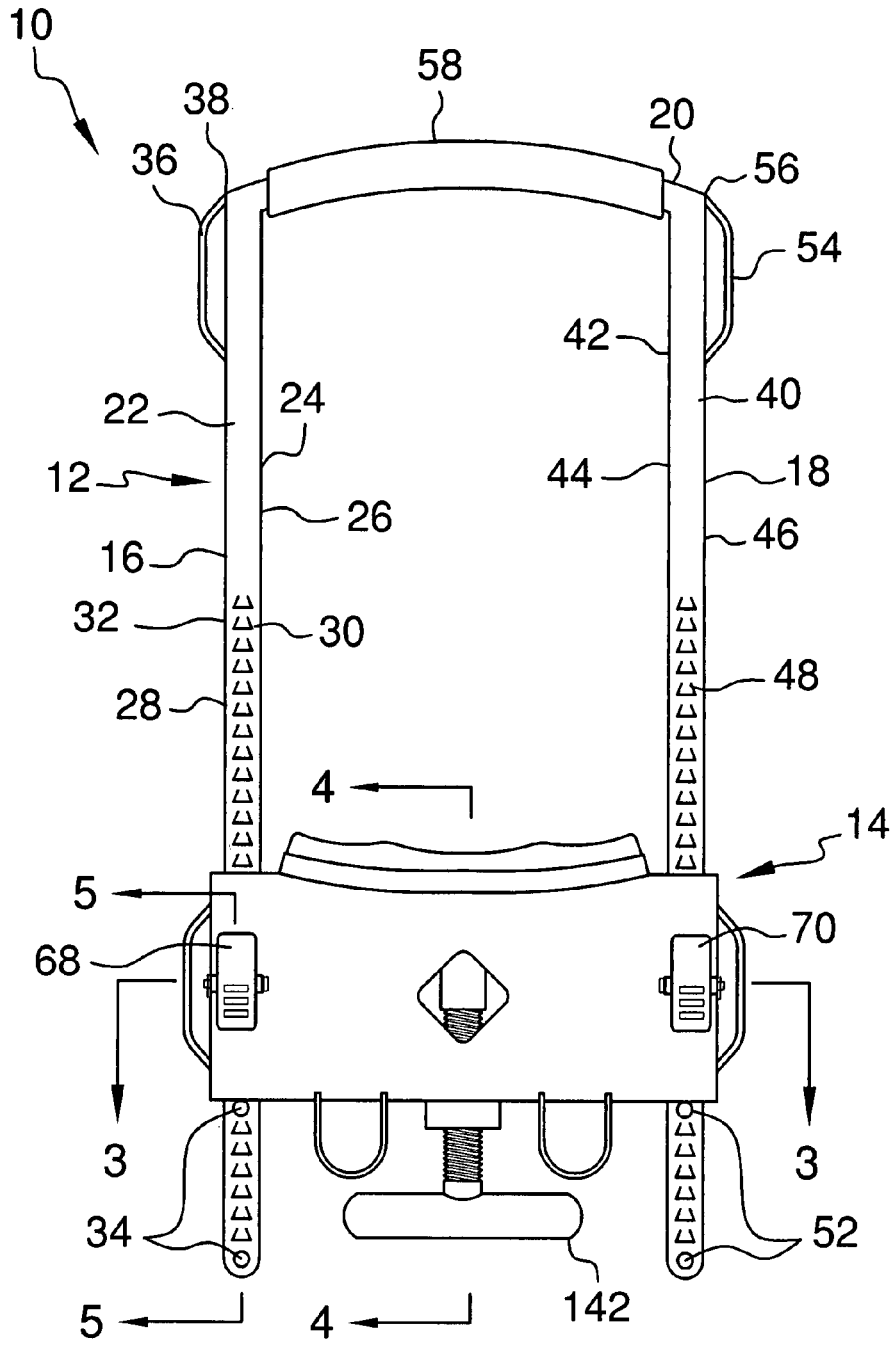
FIG. 1 illustrates a front elevational view of a ladder locking device according to the present invention showing a lock harness and a lock shuttle assembly.

Referring now to the drawings, in particular FIG. 1. illustrates a frontal view of the ladder locking device 10 in accordance with an embodiment of the invention where the ladder locking device 10 provides a harness 12 and a lock shuttle 14.

In one embodiment of the invention, the harness 12 is a U shaped member with a first arm 16 a spaced apart second arm 18 parallel to the first arm, and an intermediary arm 20 connected between the first arm 16 and the second arm 18. The first arm 16, the second arm 18, and the intermediary arm 20 may be integrally formed and cooperate together to form the harness 12.

The first arm 16 may be an elongated rectangular shaft having a uniform predefined length, a uniform predefined width, a uniform predefined height, and a rectangular cross-section. The first arm may have a front side 22, a backside 24, an inner side 26, and an outer side 28. There are a plurality of evenly spaced notches 30 starting at a predefined point 32 on the front side and extending a predefined distance along the front side of the first arm. The front side 22 includes a plurality of holes 34 at predefined locations on the front side 22 extending therethrough to the backside 24 of the first arm. The inner side 26 and the outer side 28 of the first arm are generally smooth along the outer surface of their length. The first arm 16 may provide an eyelet 36 of predefined size that protrudes from the outer side of the first arm at a predefined location 38 where the intermediary arm 20 connects to the first arm 16.

The second arm 18 is similar in function to the first arm 16 with a corresponding front side 40, backside 42, inner side 44 and opposing outer side 46. There are a plurality of evenly spaced uniform notches 48 formed along the front side 40 of the second arm that correspond with the notches 30 on the front side 22 of the first arm 16. There may be a plurality of holes 52 at predefined locations extending therethrough that correspond to the holes 34 in the first arm 16. The outer side of the second arm may have an eyelet 54 that corresponds with the eyelet 36 on the outer side 28 of the first arm 16.

The intermediary arm 20 is an elongated cambered element of a predefined length that has a uniform width and a uniform height. The intermediary arm may be surrounded by a tube-like upper pad 58 of uniform width made from a flexible material. The upper pad 58 surrounds the intermediary arm 20 and covers the intermediary arm's entire length.

Figure 2:
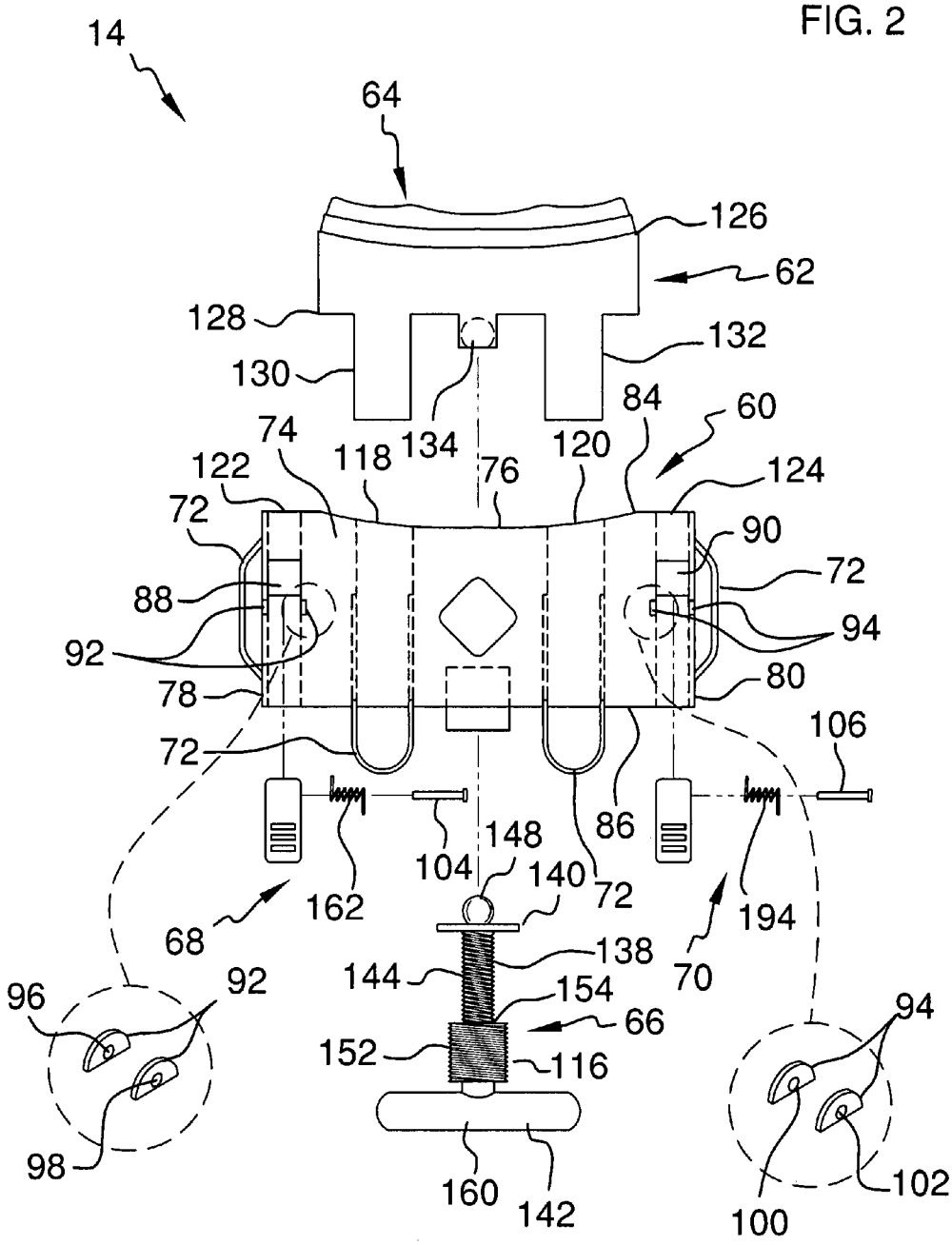
FIG. 2 illustrates an exploded view of the lock shuttle assembly shown in FIG. 1.

In one embodiment of the invention as shown in FIG. 2, the lock shuttle 14 provides a pad holder 62, a lower lock pad 64, a lock housing 60, a lock shuttle screw assembly 66, a first thumb release assembly 68, a corresponding second thumb release assembly 70 and a plurality of bungee eyelets 72. The lock shuttle 14 slides over the harness 12 and is held in place by the first and second thumb release assemblies 68, 70.

Figure 4:
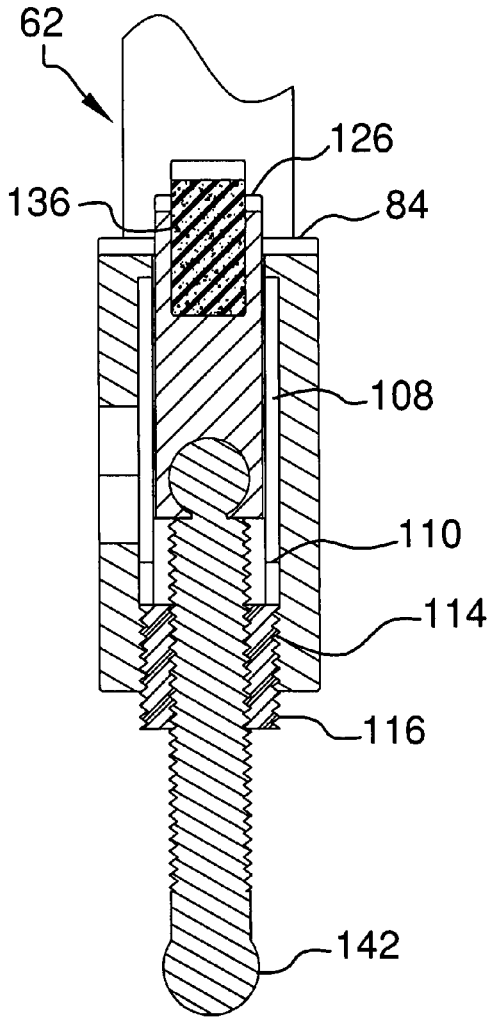
FIG. 4 illustrates a cross-sectional view of the ladder locking device taken across line 4-4 of FIG. 1.

In one embodiment of the invention as shown in FIG. 2, the pad holder 62 is a substantially cuboid member having a pair of stabilizing flanges 130, 132 and a cylindrical chamber 134. The pad holder 62 has a substantially planar top side 126 and a substantially planar bottom side 128 and is adapted to fit into a complementary recessed cavity 108 in the lock housing 60. As shown in FIG. 4, the top side of the pad holder 62 provides a channel 136 of uniform width and uniform depth that extends from a first side to a second side of the pad holder 62 along the top side 126 of the pad holder 62. The channel 136 is adapted to receive a flexible lower lock pad. The stabilizing flanges 130, 132 protrude outwardly from predefined points on the bottom side of the pad holder 62 and are adapted to fit into complementary formed pad holes associated with the lock housing. The cylindrical chamber is located at a predefined point on the bottom side of the pad holder equidistant between the pair of stabilizing flanges. The cylindrical chamber has a circular cross section having a diameter D1 and extends to a predefined depth into the pad holder.

As shown in FIG. 2. and FIG. 4, the lower lock pad 64 is a substantially flexible cuboid member having a predefined length, a predefined width, and a predefined height that is adapted to fit snugly within the channel 136 associated with the pad holder 62. The cuboid member may be made from substantially flexible resilient materials that exist or may come into existence such as, but not limited to, rubber, plastic, or other flexible resilient materials. The lower lock pad 64 permits the lock shuttle 14 to be securely fastened to a ladder while preventing the lock shuttle 14 from scratching or otherwise damaging a ladder.

The lock housing 60 may be a substantially solid rectangular member having a substantially planar front outer wall 74, an opposing substantially planar rear outer wall 76, a substantially planar first peripheral wall 78, an opposing substantially planar second peripheral wall 78, a top side 84, and an opposing substantially planar bottom side 86.

The front outer wall 74 of the lock housing has a predefined height and a predefined width. The front outer wall provides a first and second opposing pair of integrally formed arcuate flanges 92, 94 at predefined locations, and the front wall includes first and second spaced apart holes 88, 90 disposed therethrough at predefined locations through the front outer wall of the lock housing. The first and second spaced apart holes provide a means for a thumb lock assembly to mechanically communicate with the lock harness.

The first pair of arcuate flanges 92 protrudes outwardly from the front outer wall and each flange includes a hole 96, 98 therethrough at a predefined location on the flange that provides a pivot point for a thumb lock assembly.

The second pair of flanges 94 is similar to and corresponds to the first pair of flanges. The second pair of flanges 94 protrudes outwardly from the front outer wall 74 and are parallel with the first and second peripheral walls 78,80 of the lock housing. Each flange includes a hole 100, 102 disposed through each flange at a predefined point on each flange that provides a pivot point for a thumb lock assembly.

Figure 3:
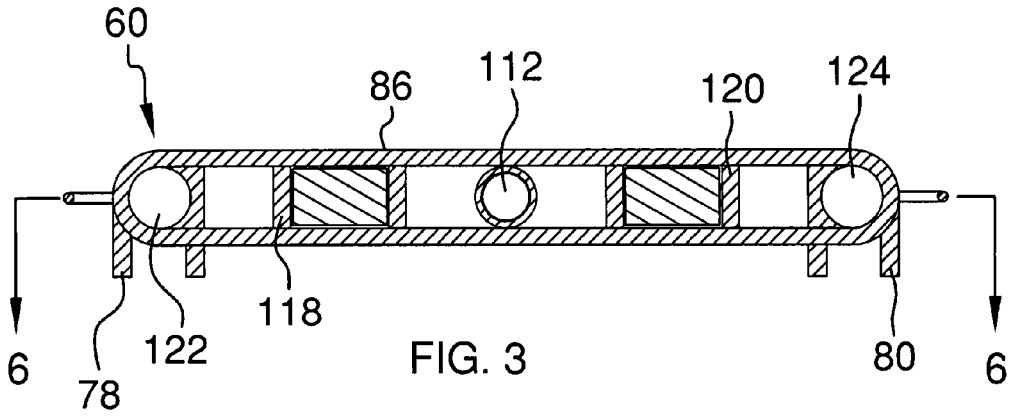
FIG. 3 illustrates a cross-sectional view of lock shuttle housing of the lock shuttle assembly taken across line 3-3 in FIG. 1.

As shown in FIG. 2. and FIG. 3, the top side 84 of the lock housing may be a substantially concave arcuate wall that extends the length of the lock housing. As shown on FIG. 4, the top side 84 provides a recessed cavity 108 that is complementary to the pad holder. The recessed cavity 108 provides first and second pad bores 118, 120 that are adapted to receive corresponding stabilizing flanges 130, 132 of the pad holder 62.

The bottom side 86 of the lock housing 60 provides a central bore 112 with a uniform predefined diameter D1 disposed from a central predefined point of the bottom side 86 and extending through the height of the lock housing through the cavity of the top side of the lock housing. The central bore includes a female threaded portion 114 (FIG. 4) that extends inwardly a predefined distance from the bottom side 86 of the lock housing and that is adapted to receive a threaded cylinder.

The lock housing provides a pair of harness bores 122, 124 (FIG. 3) that are each disposed on opposing sides and are located at a predefined distance from the central bore 112. The first and second harness bores 122, 124 are parallel to the first and second peripheral sides 78, 80 of the lock housing. The harness bores each extend through the length of the lock housing and are adapted to respectively receive the first arm 16 and the second 18 arm of the harness (FIG. 1).

Figure 6:
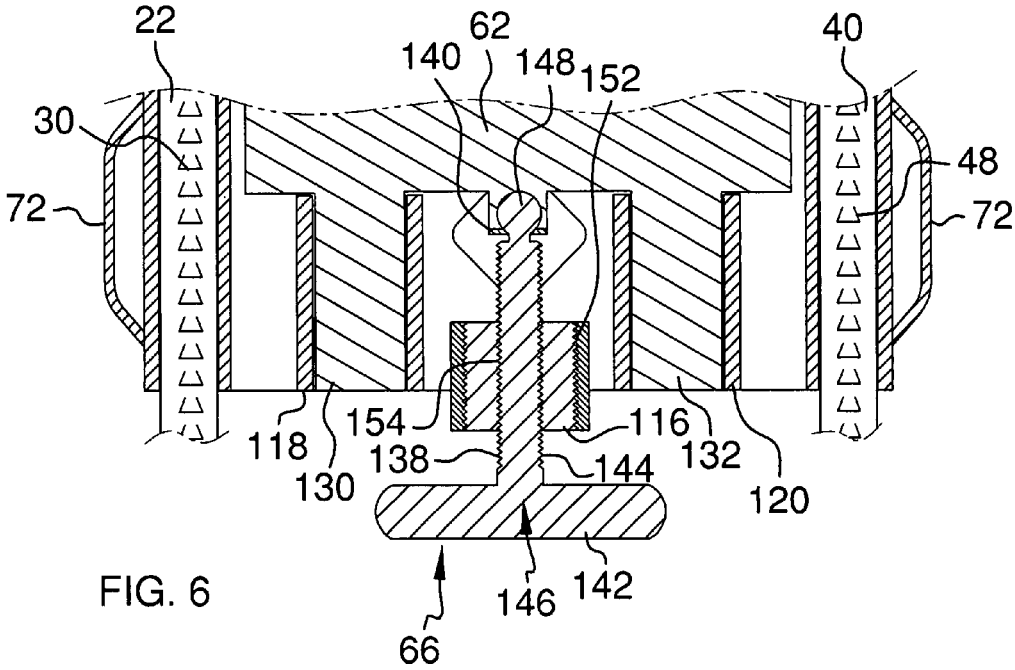
FIG. 6 illustrates a cross-sectional view of the ladder locking device taken across line 6-6 of FIG. 3.

As shown in FIG. 2 and FIG. 6, in one embodiment of the invention, the lock shuttle screw assembly 66 includes a threaded bolt 138, a joint cap 140 and a threaded tubular cylinder 116. The lock shuttle screw assembly provides a means to securely tighten the lock shuttle pad against a ladder to prevent the ladder from moving.

The threaded bolt 138 may be an elongated threaded screw having a predefined length and a predefined diameter, an integrally formed adjustment knob 142 at one distal end of the elongated threaded screw, a male threaded portion 144, and an integrally formed solid spherical ball 148 at an opposing second distal end of the elongated threaded bolt adapted to fit into the cylindrical chamber of the pad holder. The adjustment knob 142 may be an elongated rod 146 forming a "T handle" with a central portion 160 integrally formed with the elongated threaded screw and may be perpendicular to the longitudinal direction of the elongated threaded screw. The solid spherical ball 148 has a predefined diameter D2 that may be larger than the predefined diameter D3 of the elongated threaded screw.

The joint cap 140 provides a substantially flat circular collar with a centrally disposed hole. The joint cap 140 has a predefined interior diameter D4, and a predefined exterior diameter D5. The interior diameter D4 of the joint cap may be adapted to fit loosely between the spherical ball 148 and the male threaded portion 144 of the threaded bolt. The exterior diameter D5 of the joint cap may be adapted to mate securely with the circular chamber 134 of the pad holder. When the spherical ball 148 is inserted into the cylindrical chamber 134 of the pad holder 62, the joint cap 140 is in contact with the cylindrical chamber 134 of the pad holder 62 and the spherical ball is captured within cylindrical chamber 134 preventing the threaded bolt 138 from separating from the pad holder 62.

As shown in FIG. 3, FIG. 4 and FIG. 6, the threaded tubular cylinder 116 may be a hollow elongated cylindrical element having exterior male threads 152 and interior female threads 154. The threaded cylinder is defined by a cylindrical wall having a predefined thickness, an outer male threaded portion 152 adapted to mate with the central bore 112 of the lock housing 60 and an inner female threaded portion 154 adapted to mate with the threaded bolt 138. The threaded cylinder protrudes outwardly a predefined distance from the bottom side of the lock shuttle housing when the threaded cylinder is mated with the central bore of the lock shuttle housing through the bottom side of the lock shuttle housing.

When the lock shuttle screw assembly 66 is assembled into with the lock shuttle housing 60, the adjustment knob of the elongated threaded bolt 138 is in mechanical communication with the pad holder 62 and adjusts the pad holder 62 from a retracted position to an extended position when the adjustment knob 142 is twisted.

Figure 7:
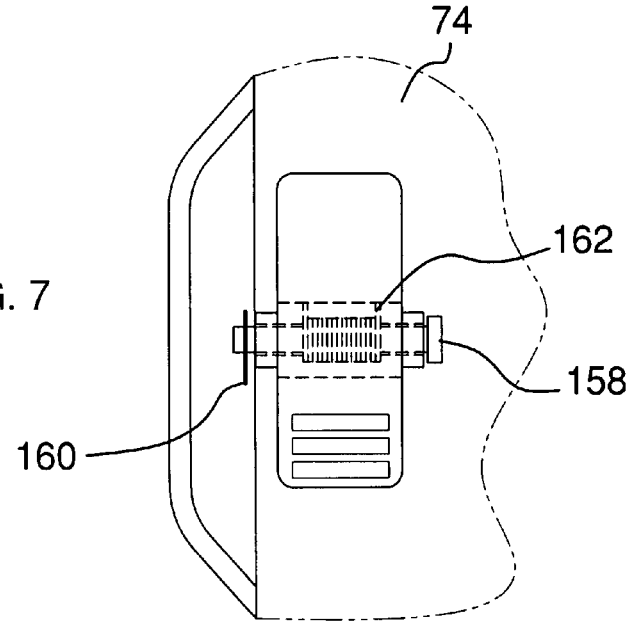
FIG. 7 illustrates an enlarged partial cross sectional view of a thumb lock assembly of the lock shuttle housing shown across line 7-7 of FIG. 5.

As shown in FIG. 2, FIG. 3, and FIG. 7, the first and second thumb release assemblies 68, 70 each provide a first and a second thumb lock 156, 180. FIG. 7 shows a thumb release assembly 68 with thumb release assembly 80 having identical elements. Each thumb release assembly has a locking pin 158, a retaining pin 104 and a spring 162. The first and second thumb locks 156, 180 may each define a first and second latch with an associated predefined length and a predefined width. Each latch may have an associated first and second tab portion 164, 182 that moves from a respective open position to a respective closed position and may each have a centrally located protrusion 166 across the width of each thumb lock that has a centrally located bore disposed through the width of the protrusion.

Figure 5:
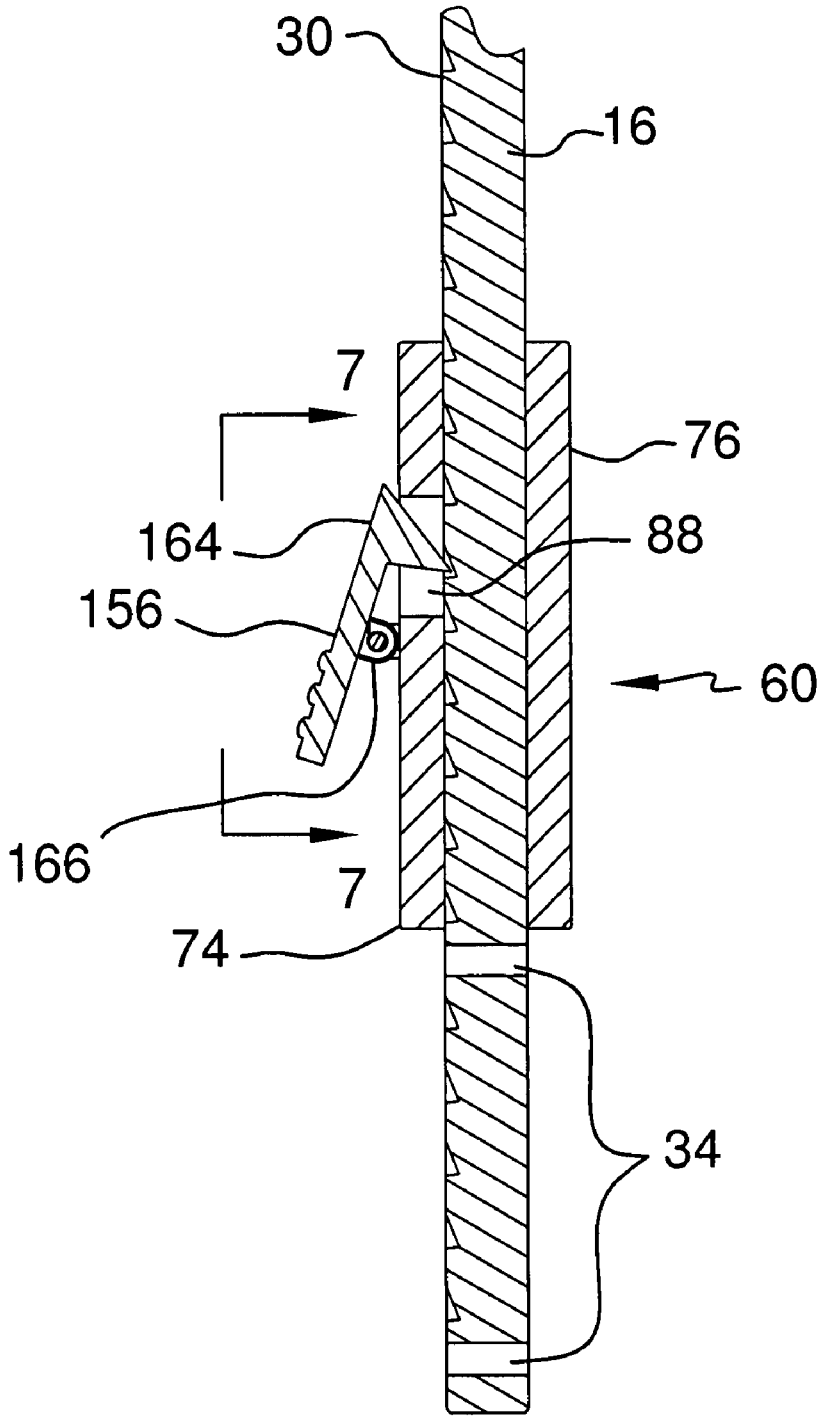
FIG. 5 illustrates a cross-sectional view of the ladder locking device taken across line 5-5 of FIG. 1.

As shown in FIG. 5, the tab portion 164 is adapted to: permit the lock housing 60 to slide onto the harness 12 when each associated latch is in a respective closed position, permit the lock housing to slide off the harness 12 when the latch is in an open position, and prevent the lock housing from sliding off the harness when each respective latch is in a closed position. The tab portions 164 is each adapted to protrude through the hole 88 in the front outer wall 74 of the lock housing 60 and fit securely into the notches on the arm of the harness to prevent the lock housing 60 from sliding off the harness 12 when each respective latch is in a closed position.

Each protrusion 166 may be centrally located on each respective latch and may have an associated bore disposed through the center of each respective protrusion penetrating through the width of each respective latch and respectively having associated first and second diameters D6, D7 large enough to accept the retaining pins 104, 106 respectively.

Each of the first and second retaining pins 104, 106 are adapted to fit into each of the bores 168 in the protrusion 166 of each of the thumb locks 156 and into the holes of the first and second pivot points to hold the thumb locks 156 in position while permitting the thumb lock to move from an associated open position to an associated closed position.

The locking pin 158 is adapted to hold the retaining pin 104 in position.

The first and second springs 162, 194 each operate as a biasing member between the first and second thumb lock 156, 180 respectively and the front outer wall 74 of the lock housing 60 to bias the associated tab of the thumb lock to grip the notches of the associated arm of the lock harness when the lock housing 60 is slid onto the arm of the lock harness. The spring may be any resilient biasing member such as a helical spring with a central spring hole.

As shown in FIG. 5 and FIG. 7, the first and second thumb release assemblies 68, 70 may be assembled on the first and second set of pivot points respectively on the front outer wall of the lock housing 60. The first and second thumb locks are each located between the first and second set of pivot points respectively with the hole of the first protrusion element aligned with the central holes of the set of first pivot points and the central spring hole of the first spring. The first retaining pin is inserted through one hole of the first pivot points, the first central spring hole, the hole of the first protrusion element, and the other hole of the first pivot points. The first locking pin is inserted into the hole of the first retaining pin to hold it in position. The second retaining pin is inserted through one of the holes of the second pivot points, the second central spring hole, the hole of the second protrusion element, and the other hole of the second pivot point. The second locking pin is inserted into the hole of the second retaining pin to hold it in position.

Figure 8:
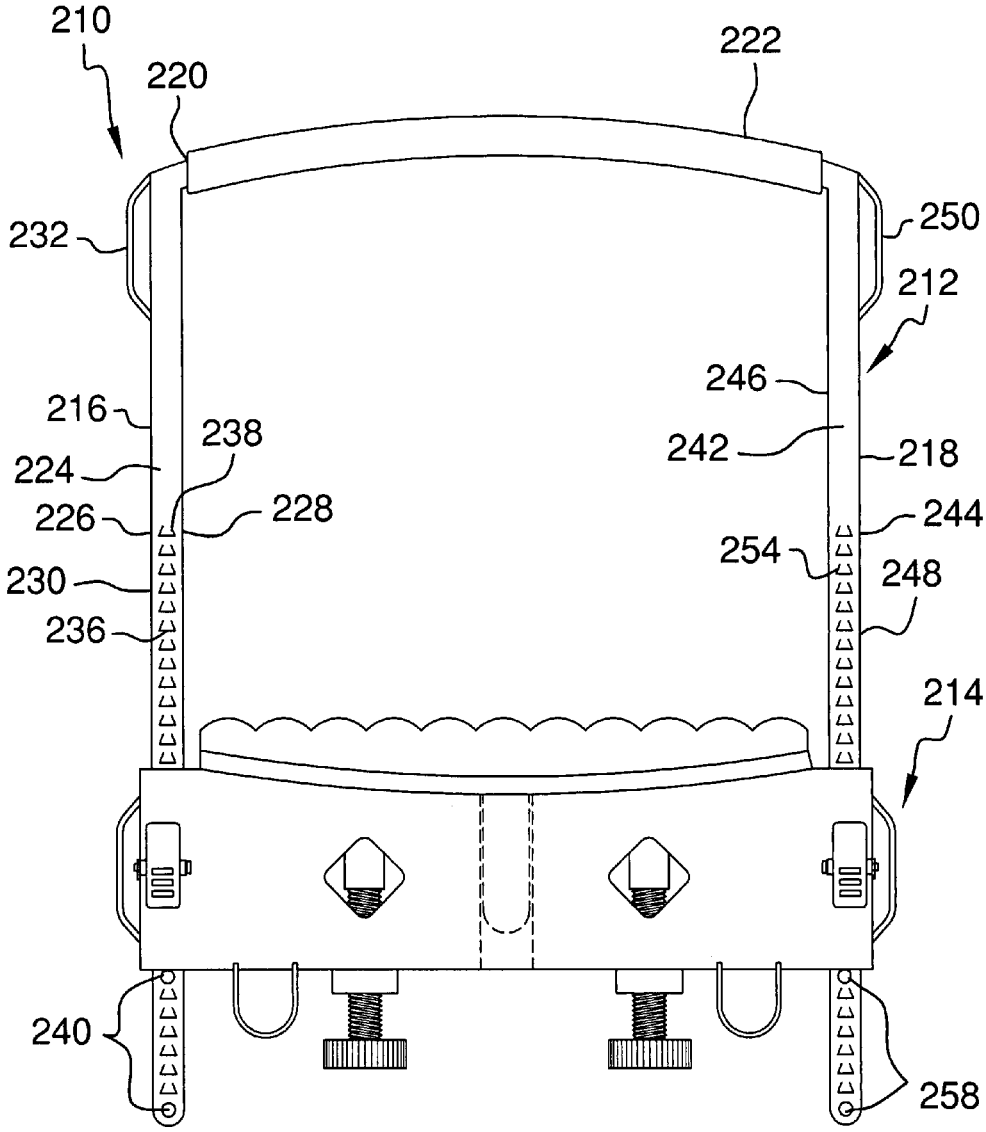
FIG. 8 illustrates a front view of the ladder locking device in another embodiment of the invention.

In one embodiment of the invention as shown in FIG. 8, the ladder locking system 210 provides a harness 212 and a lock shuttle 214.

The harness 212 is a U-shaped member including a first arm 216, a spaced apart second arm 218 parallel to the first arm, and an intermediary arm 220 connected between the first arm 216 and the second arm 218. The first arm 216, second arm 218, and intermediary arm 220 may be integrally formed and cooperate together to form the harness 212.

The first arm 216 may be an elongated rectangular shaft having a uniform predefined length, a uniform predefined width, a uniform predefined height, and a rectangular cross-section. The first arm may have a front side 224, a backside 226, an inner side 228, and an outer side 230. There are a plurality of evenly spaced notches 236 starting at a predefined point 238 on the front side 224 and extending a predefined distance along the front side of the first arm. The front side includes a plurality of holes 240 at predefined locations on the front side extending therethrough to the backside of the first arm. The inner side 228 and outer side 230 of the first arm are generally smooth along the outer surface of their length. The first arm may provide an eyelet 232 of predefined size that protrudes from the outer side of the first arm at a predefined location where the intermediary arm connects to the first arm.

The second arm 218 is similar in structure to the first arm and includes a corresponding front side 242, backside 244, inner side 246 and outer side 248. The front side 242 of the second arm has notches 254 that correspond with the notches on the front side of the first arm. The front side of the second arm may have a plurality of holes 258 extending therethrough that correspond to the holes in the first arm. The outer side 248 of the second arm may have an eyelet 250 that corresponds with the eyelet on the outer side of the first arm.

The intermediary arm 220 is an elongated cambered element of a predefined length that has a uniform width and a uniform height. The intermediary arm may be surrounded by a tubelike upper pad 222 of uniform width made from a flexible material. The upper pad surrounds the intermediary arm and covers the intermediary arm's entire length.

Figure 9:
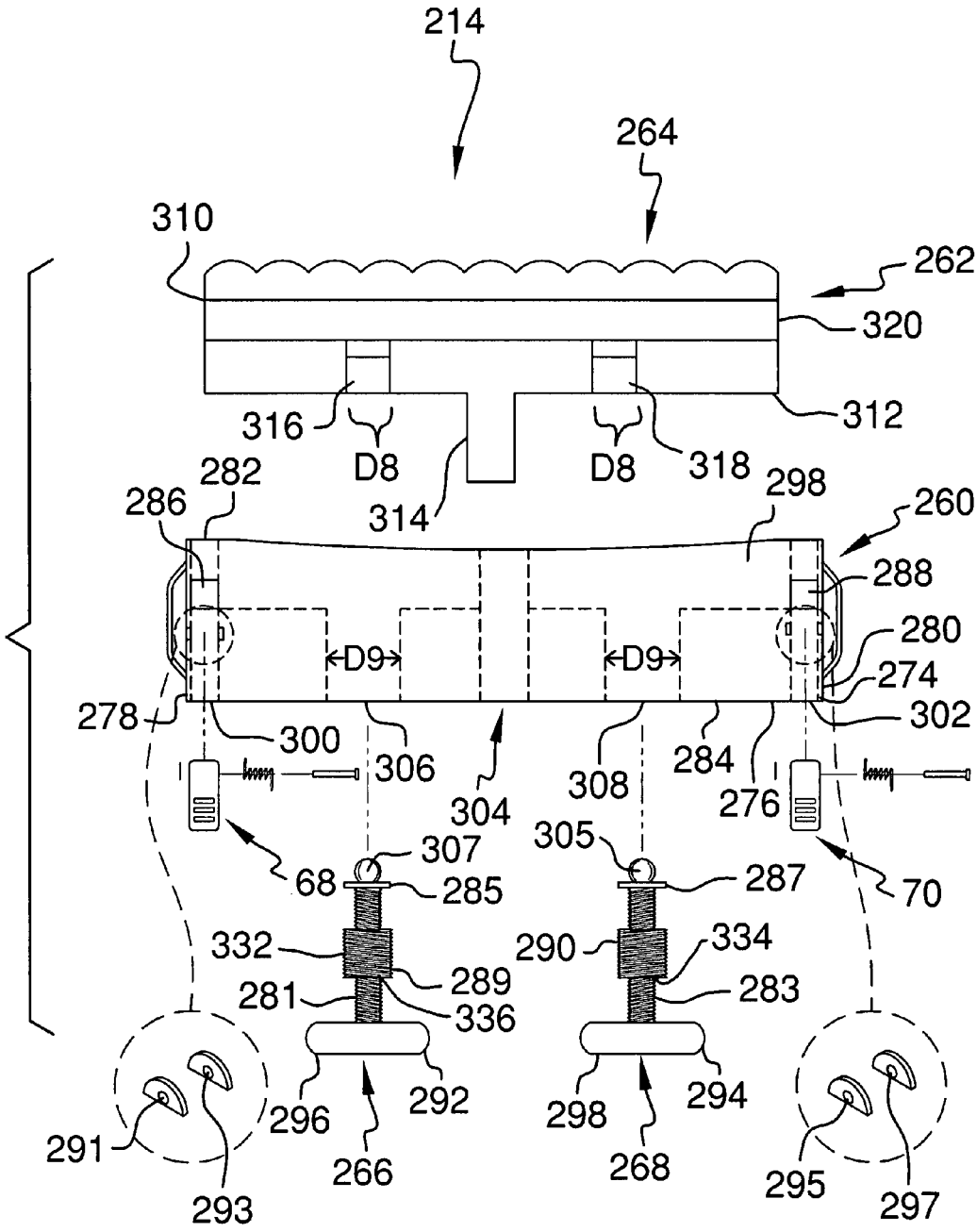
FIG. 9 illustrates an exploded view of the lock shuttle assembly shown in FIG. 8.

In one embodiment of the invention as shown in FIG. 9. The lock shuttle 214 provides a pad holder 262, a lower lock pad 264, a lock housing 260, a first and second lock shuttle screw assembly 266, 268, a first and second thumb release assembly 68, 70 and a plurality of bungee eyelets. The lock shuttle slides over the harness and is held in place by the first and second thumb release assemblies.

In one embodiment of the invention as shown in FIG. 9, the pad holder 262 is a substantially cuboid member having a stabilizing flange 314, first and second cylindrical chambers 316, 318, and a pad channel 320. The pad holder has a substantially planar top side 310 and a substantially planar bottom side 312 and is adapted to fit into a complementary recessed cavity in the lock housing 260. The stabilizing flange 314 protrudes outwardly from a predefined point on the bottom side of the pad holder and is adapted to fit into a central stabilizing bore 304 associated with the lock housing. The first and second cylindrical chambers 316, 318 are each located at separate predefined points on the bottom side 312 of the pad holder on opposite sides of the stabilizing flange 314. The cylindrical chamber has a circular cross section having a uniform diameter D8 and extends to a predefined depth into the pad holder. The channel 320 is a cavity in the top side 310 of the pad holder having a uniform width and uniform depth that extends the length of the pad holder 262. The channel 320 is adapted to receive a flexible lower lock pad.

The lower lock pad 264 is a substantially flexible cuboid member having a predefined length, a predefined width, and a predefined height that is adapted to fit snugly within the channel 320 associated with the pad holder 262. The lower lock pad permits the lock shuttle to be securely fastened to a ladder.

The lock housing 260 is a substantially solid rectangular member having a substantially planar front outer wall 274, an opposing substantially planar rear outer wall 276, a substantially planar first peripheral wall 278, an opposing substantially planar second peripheral wall 280, a top side 282, and an opposing substantially planar bottom side 284.

The front outer wall 274 has a predefined height and a predefined width. The front outer wall 274 provides a first and second opposing pair of integrally formed arcuate flanges 291, 293, 295, 297 at predefined locations, and the front outer wall includes first and second spaced apart holes 286, 288 disposed therethrough at predefined locations through the front outer wall 274 of the lock housing. The first and second spaced apart holes provide a means for a thumb lock assembly to mechanically communicate with the lock harness.

The first pair of flanges 291, 293 protrude outwardly from the front outer wall and are parallel with the first and second peripheral walls 278, 280 of the lock housing. Each flange includes a hole disposed therethrough at a predefined location on the flange that is adapted to receive a retaining pin and provides a pivot point for a thumb lock assembly.

The second pair of flanges 295, 297 is similar in structure to and corresponds to the first pair of flanges. The second pair of flanges protrudes outwardly from the front wall and are parallel with the first and second peripheral walls 278, 280 of the lock housing. Each flange includes a hole disposed through the flange at a predefined point on the flange that is adapted to receive a retaining pin and provides a pivot point for a thumb lock assembly.

The top side 282 of the lock housing 260 may be a substantially concave arcuate wall that extends the length of the lock housing. The top side 282 provides a recessed cavity 262 that is complementary to the pad holder. The recessed cavity 262 provides a central stabilizing bore 304 that is adapted to receive the corresponding flange 314 of the pad holder.

The bottom side 284 of the lock housing 260 provides first and second bolt bores 306, 308 each having a uniform predefined diameter D9, wherein each bolt bore 306, 308 is disposed through spaced apart predefined points on the bottom side 284 and extending through the height of the lock housing through the cavity 298 in the top side 282 of the lock housing. The first and second bolt bores 306, 308 each include an associated female threaded portion that extends inwardly a predefined distance from the bottom side of the lock housing and that are each adapted to receive a threaded cylinder.

The lock housing 260 provides a pair of harness holes 300, 302 that are each disposed on opposite sides and a predefined distance from the central stabilizing bore 304. The first and second harness holes 300, 302 are parallel to the first and second peripheral sides 278, 280 of the lock housing 260. The harness holes each extend through the length of the lock housing and are adapted to respectively receive the first arm 216 and the second arm 218 of the harness 212.

In an embodiment of the invention, the first and second lock shuttle screw assemblies 266, 268 each provide a male threaded bolt 281, 283, a joint cap 285, 287 and a threaded tubular cylinder 289, 290. The first and second lock shuttle screw assemblies 266, 268 provide a means to securely tighten the lower lock pad 262 against a ladder to prevent the ladder from moving.

Each threaded bolt 281, 283 may be an elongated male threaded screw having a predefined length and a predefined diameter, an integrally formed adjustment knob 292, 294 at one distal end of the elongated threaded shaft, a threaded portion, and an integrally formed solid spherical ball 305, 307 at an opposing distal end of the elongated threaded shaft. Each solid spherical ball 305, 307 of each threaded bolt 281, 283 is adapted to fit into corresponding cylindrical chambers 316, 318 of the pad holder 262. The solid spherical balls 305, 307 each have a predefined diameter that may be larger than the predefined diameter of each elongated threaded bolt 281, 283. Each adjustment knob 292, 294 may be an elongated rod 296, 298 with a central portion integrally formed with each threaded shaft 281, 283 respectively and may be perpendicular to the longitudinal direction of the threaded shaft.

Each joint cap 285, 287 provides a substantially flat circular collar having a predefined interior diameter and a predefined exterior diameter. The interior diameter of each joint cap may be adapted to fit loosely between the spherical ball and the threaded portion of the corresponding threaded bolt. The exterior diameter of each joint cap may be adapted to mate securely with the interior diameter of a corresponding cylindrical bore in the pad holder. When the spherical balls are inserted into the cylindrical bore of the pad holder, the joint caps are then each inserted into a respective cylindrical bore of the pad holder to prevent each threaded bolt from separating from the pad holder.

Each threaded tubular cylinder 289, 290 may be a hollow elongated cylindrical element having exterior male threads 332, 334 and interior female threads 334, 336. Each threaded cylinder is defined by a cylindrical wall having a predefined thickness, an outer male 332, 334 threaded portion adapted to mate with the bore of the lock housing and an inner female threaded portion 336, 338 adapted to mate with the threaded bolt. Each threaded cylinder 289, 290 protrudes outwardly a predefined distance from the bottom side of the lock shuttle housing when the first and second is respectively mated with the corresponding first and second bolt holes of the lock shuttle housing through the bottom side of the lock shuttle housing.

When first and second lock shuttle screw assemblies are assembled into with the lock shuttle housing, the first and second adjustment knobs of the threaded bolts are in mechanical communication with the pad holder and adjust the pad holder from a retracted position to an extended position when the adjustment knobs are twisted in a complimentary manner.

As shown in FIG. 2, FIG. 3, FIG. 5, FIG. 7, and FIG. 8, the first and second thumb release assemblies 68, 70 each having the same parts with the first thumb release assembly shown in FIG. 7 provide a thumb lock 156, 180, a first and a second retaining pin 158, 188, a locking pin 158 and a spring respectively 162, 194. The first thumb locks 156, 180 may each define a latch with an associated predefined length and a predefined width. Each latch may have an associated tab portion 164 that moves from a respective open position to a respective closed position and may each have a centrally located first and second protrusion 166 across the width of each thumb lock that has a centrally located bore 88 disposed through the width of the protrusion.

As shown in FIG. 1, FIG. 2, and FIG. 5, the tab portions 164, 182 are adapted to: permit the lock housing 60 to slide onto the harness 12 when each associated latch is in a respective closed position, permit the lock housing to slide off the harness 12 when the latch is in an open position, and prevent the lock housing from sliding off the harness when each respective latch is in a closed position. The tab portions 164, 182 are each adapted to protrude through the first and second holes 88, 90 in the front outer wall 74 of the lock housing 60 and fit securely into the notches on the first and second arm 16, 18 of the harness respectively to prevent the lock housing 60 from sliding off the harness 12 when each respective latch is in a closed position.

As shown in FIG. 5 and FIG. 7, each protrusion 166 may be centrally located on each respective latch and may have an associated bore disposed through the center of each respective protrusion penetrating through the width of each respective latch and respectively having associated diameter D6 large enough to accept the retaining pins.

Each of the locking pins 158 are adapted to fit into each of the bores 168 in the protrusion 166 of each of the thumb locks 156, 180 respectively and into the holes of the first and second pivot points to hold the first and second thumb locks 156, 180 respectively in position while permitting the first and second thumb lock respectively to move from an associated open position to an associated closed position.

The retaining pins 104, 106 are each adapted to hold the locking pins 158 in position.

The first and second springs 162, 194 each operate as a biasing member between the first and second thumb lock 156, 180 respectively and the front outer wall 74 of the lock housing 60 to bias the 164 of the thumb lock to grip the notches of the associated first and second arm 16, 18 of the lock harness when the lock housing 60 is slid onto the first arm 16 and second arm 18 of the lock harness. The first and second spring 162 may be any resilient biasing member such as a helical spring.

As shown in FIG. 2, the first and second thumb release assemblies 68, 70 may be assembled on the first and second set of pivot points 88, 90 respectively on the front outer wall of the lock housing 60. The first and second thumb locks are each located between the first and second set of pivot points respectively with the hole of the first protrusion element aligned with the central holes of the set of first pivot points and the central spring hole of the first spring. The first retaining pin is inserted through one hole of the first pivot points, the first central spring hole, the hole of the first protrusion element, and the other hole of the first pivot points. The first locking pin is inserted into the hole of the first retaining pin to hold it in position. The second retaining pin is inserted through one of the holes of the second pivot points, the second central spring hole, the hole of the second protrusion element, and the other hole of the second pivot point. The second locking pin is inserted into the hole of the second retaining pin to hold it in position.

In operation, the first and second arms of the harness are inserted over a rung of a ladder or a bracing member of a ladder and over an element of a ladder rack. The first and second arms of the harness are inserted into respective first and second harness holes located in the top side on of the lock housing. The lock housing is pushed onto the harness to an intermediate point along the notches of the first arm and the second arm where the ladder is held snugly against the ladder rack. The adjustment knob is twisted causing the pad holder to extend from the top of the lock housing and tightening the lock pads against the ladder and the ladder rack holding the ladder securely in position. A padlock may be inserted in a lock hole on an arm of the harness to prevent the ladder from being stolen.

To remove the ladder lack, the padlock is unlocked and removed from the harness. The adjustment knob is twisted causing the pad holder to retract into the lock housing and loosening the ladder from the ladder rack. The first thumb release and the second thumb release are simultaneously compressed to open the thumb locks and releasing the tabs from the notches on the first and second arms of the harness. The lock housing is pulled off the harness and the thumb releases are released causing the ladder to be released from the ladder lock.

What is claimed is:

1. A ladder locking device comprising:

a harness defined by a "U" shaped member having a first arm having a plurality of first arm notches a second arm spaced apart from and parallel to the first arm having a plurality of second arm notches and an intermediary arm integrally formed with the harness disposed between the first arm and the second arm; and a lock shuttle having a lock housing having first and second harness bores and a central pad bore, a pad holder, a lower lock pad, a lock shuttle screw assembly, a first thumb release assembly, and a second thumb release assembly, wherein the first and second harness bores of the lock shuttle are adapted to slide over the harness thereby holding the lock shuttle in a fixed position with respect to the harness by the first and second thumb release assemblies.

2. The ladder locking device of claim 1, wherein the intermediary arm comprises an elongated cambered element having a square cross section and a tubelike upper pad of uniform width made from a flexible material and adapted to cover the elongated cambered element.

3. The ladder locking device of claim 1, wherein the first arm comprises:

a plurality of first arm holes formed at predefined locations along the first arm that each extend through the first arm and are each adapted to receive a pad lock that prevents the lock shuttle from being removed from the harness.

4. The ladder locking device of claim 1, wherein the second arm comprises:

a plurality of second arm holes formed at predefined locations along the second arm that extend through the second arm and are each adapted to receive a pad lock that prevents the lock shuttle from being removed from the harness.

5. The ladder locking device of claim 1, wherein the pad holder is defined by a cuboid member having a cavity adapted to receive a flexible lock pad, a pair of flanges, and a cylindrical chamber having a predefined diameter.

6. The ladder locking device of claim 5, wherein the lock shuttle screw assembly comprises:

a threaded bolt having an elongated male threaded portion, a spherical ball, and an adjustment knob, wherein the spherical ball and the adjustment knob are integrally formed with the threaded bolt; a threaded cylinder having interior female threads and exterior male threads wherein the interior female threads are adapted to receive the threaded bolt; and a joint cap defined by a flat circular ring having a predefined interior diameter and a predefined external diameter wherein the joint cap is adapted to fit loosely between the elongated male threaded portion and the spherical ball of the threaded bolt.

7. The ladder locking device of claim 6, wherein the lock housing is defined by a cuboid member having a first and a second harness bore each adapted to receive corresponding first and second arms of the harness;

a recessed cavity that is complimentary to the pad holder having a first and a second stabilizing bore each adapted to receive corresponding first and second flanges associated with the pad holder; and a central female threaded bore adapted to receive the threaded cylinder.

8. The ladder locking device of claim 7, wherein the cylindrical chamber of the pad holder is adapted to receive the threaded bolt spherical ball, and wherein the cylindrical chamber is adapted to receive and securely retain the joint cap of the shuttle screw assembly within the chamber.

9. The ladder locking device of claim 1, wherein the lock shuttle comprises:

a lock housing having a first and a second harness bores and a first and a second pad bores, a pad holder, a lower lock pad, a first lock shuttle screw assembly, a second lock shuttle screw assembly, a first thumb release assembly, and a second thumb release assembly, wherein the first and the second harness bores of the lock shuttle are adapted to slide over the harness thereby retaining the lock shuttle in a fixed position with respect to the harness by the first and the second thumb release assemblies.

10. The ladder locking device of claim 9, wherein the pad holder is defined by a cuboid member having a cavity adapted to receive a flexible lock pad, a stabilizing flange, and a pair of cylindrical chambers each having a predefined diameter.

11. The ladder locking device of claim 10, wherein the first lock shuttle screw assembly provides a threaded bolt having an elongated male threaded portion a spherical ball, and an adjustment knob, wherein the spherical ball and the adjustment knob are integrally formed with the threaded bolt;

a threaded cylinder having interior female threads and exterior male threads wherein the interior female threads are adapted to receive the threaded bolt; and a joint cap defined by flat circular ring having a predefined interior diameter and a predefined external diameter wherein the joint cap is adapted to fit loosely between the elongated male threaded portion and the spherical ball of the threaded bolt such that the threaded bolt may freely rotate with respect to the joint cap.

12. The ladder locking device of claim 11, wherein the second lock shuttle screw assembly provides a threaded bolt having an elongated male threaded portion a spherical ball, and an adjustment knob, wherein the spherical ball and the adjustment knob are integrally formed with the threaded bolt; and a threaded cylinder having interior female threads and exterior male threads wherein the interior female threads are adapted to receive the threaded bolt, and a joint cap defined by flat circular ring having a predefined interior diameter and a predefined external diameter wherein the joint cap is adapted to fit loosely between the elongated male threaded portion and the spherical ball of the threaded bolt.

13. The ladder locking device of claim 12, wherein the lock housing is defined by a cuboid member having a first and a second harness bore each adapted to receive corresponding first and second arms of the harness;

a recessed cavity that is complimentary to the pad holder having a central stabilizing bore adapted to receive a corresponding flange of the pad holder; and a first and second female threaded bore adapted to receive corresponding threaded cylinders of the first and second lock shuttle assemblies.

14. The ladder locking device of claim 13, wherein the first cylindrical chamber of the pad holder is adapted to receive the first spherical ball of the corresponding threaded bolt, and wherein the first cylindrical chamber is adapted to receive and securely retain the corresponding joint cap of the first shuttle screw assembly within the first cylindrical chamber.

15. The ladder locking device of claim 14, wherein the second cylindrical chamber of the pad holder is adapted to receive the second spherical ball of the corresponding threaded bolt, and wherein the second cylindrical chamber is adapted to receive and securely hold the corresponding joint cap of the second shuttle screw assembly within the second cylindrical chamber.

* * * * *